US006035571A

United States Patent [19]

Hsu

[11] Patent Number: 6,035,571

[45] Date of Patent: Mar. 14, 2000

[54] PHOTOGRAPH FRAME

[76] Inventor: Junior Julian Hsu, 3633 Palm Canyon, Northbrook, Ill. 60062

[21] Appl. No.: 09/061,159

[22] Filed: Apr. 16, 1998

[51] Int. Cl.[7] ..... G09F 1/12

[52] U.S. Cl. ..... 40/757; 40/768; 40/781

[58] Field of Search ..... 40/732, 757, 761, 40/764, 768, 772, 776, 777, 781, 800, 159, 209, 642.02

[56] References Cited

U.S. PATENT DOCUMENTS

| | | | |
|---|---|---|---|
| 4,182,062 | 1/1980 | Krokos et al. | 40/209 |
| 4,736,539 | 4/1988 | Dickinson | 40/209 X |
| 4,891,895 | 1/1990 | DaLaquil, Jr. | 40/209 |
| 5,119,574 | 6/1992 | King | 40/776 X |
| 5,230,172 | 7/1993 | Hsu | 40/781 X |

*Primary Examiner*—Brian K. Green
*Attorney, Agent, or Firm*—Pro-Techtor International Services

[57] ABSTRACT

A photograph frame inlcuding an intermediate plate, a back plate and a face plate. The intermediate plate has an inserting face, and at the edge of the inserting face ther is a fixing frame to receive a photograph. The back plate has a recess, and the intermediate plate can be inserted into the recess and fixed in it. The surface of the recess part inlcludes a plurality of hanging holes which align with a plurality of hanging holes in the intermediate plate. The photograph is put into the fixing frame and fixed in positino by pushing the face plate into the fixing frame. If the user would like to take out the photograph, he can use his finger to push on the photograph and the face plate through the hanging holes. In addition, the photograph frame can be hung on a wall by means of the hanging holes.

4 Claims, 6 Drawing Sheets

PHOTOGRAPH FRAME

BACKGROUND OF THE INVENTION (1) Field of the Invention

This invention relates to a photograph frame, and more particularly is a photograph frame in which the photograph can be taken out easily and quickly.

(2) Description of the Prior Art

The photograph frame is used frequently in ordinary living. Nearly everyone likes to put photographs in frames to preserve them.

The conventional photograph frame, such as shown in FIG. 1, is composed of a back plate (A), a frame (D) and a plurality of fixing pieces (B) and screws (C). The frame (D) can be made in various configuraitons. The photograph is installed between a transparent face plate and the back plate (A). One end of each fixing piece (B) is fixed on the back plate (A) by means of the fixing screws (C). As the user puts the photograph into the photograph frame, he can rotate the fixing pieces (B) to cover and secure the edge of the back plate (A). If the user would like to take out or replace the photograph, he must rotate the fixing pieces (B) to remove the back plate (A). Most of conventional photograph frames have some deficiencies, such as the following:

(I) The conventional photograph frame is made of wood or metal. This is expensive to manufacture.

(II) The transparent plate of conventional photograph frame is made of glass. If the photograph frame falls from the shelf to the floor, the transparent plate breaks. The user must spend money to buy a new photograph frame and discard the broken photograph frame.

(III) The conventional metal photograph frame is very expensive and heavy. It is very inconvenient for the user to carry such kind of photograph frame.

(IV) It is very inconvenient for the user to remove the photograph from the conventional photograph frame that uses fixing pieces and fixing screws to secure the back plate. The user must spend much time and use a lot of force to rotate the fixing pieces to open or close the back plate.

SUMMARY OF THE INVENTION

It is therefore the main object of this invention to provide a photograph frame which has a plurality of hanging holes for hanging the photograph frame on a wall. Furthermore, the user can use his finger to push on the photograph and the face plate through the hanging holes to remove the face plate from the photograph frame and take out the photograph quickly and easily.

It is another object of this invention to provide a photograph frame which is very light, but still is durable. Furthermore, its manufacturing cost is lower than that of the conventional photograph frame.

BRIEF DESCRIPTION OF THE DRAWINGS

In the drawings, which illustrate the preferred embodiments and modes of operation of the invention, and in which like reference characters designate the same or similar parts throughout the several views.

DETAILED DESCRIPTION OF THE PREFERRED EMBODIMENT

Figure 1:
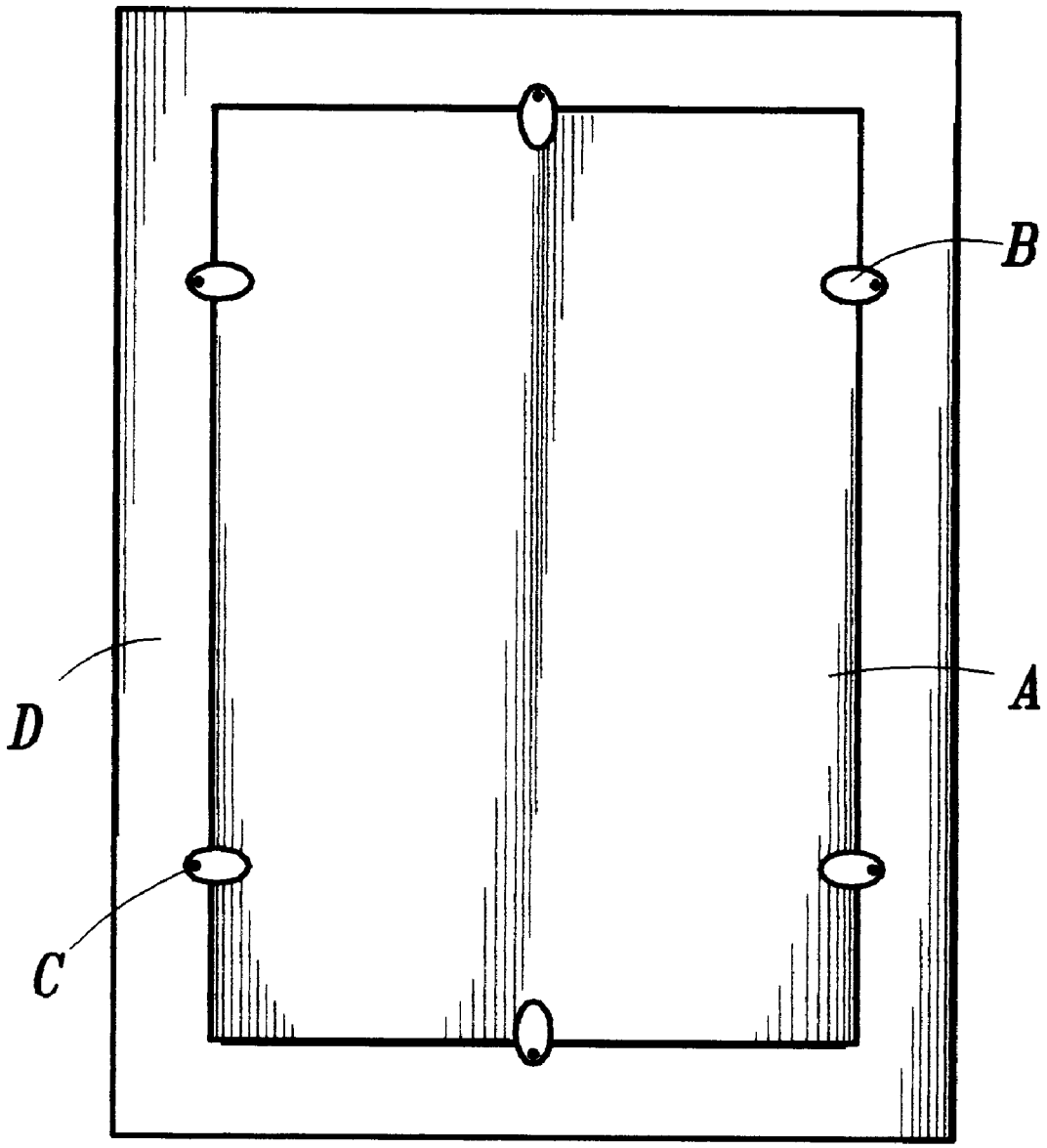
FIG. 1 PRIOR ART
FIG. 1 is a back plan view of a conventional photograph frame.
Figure 2:
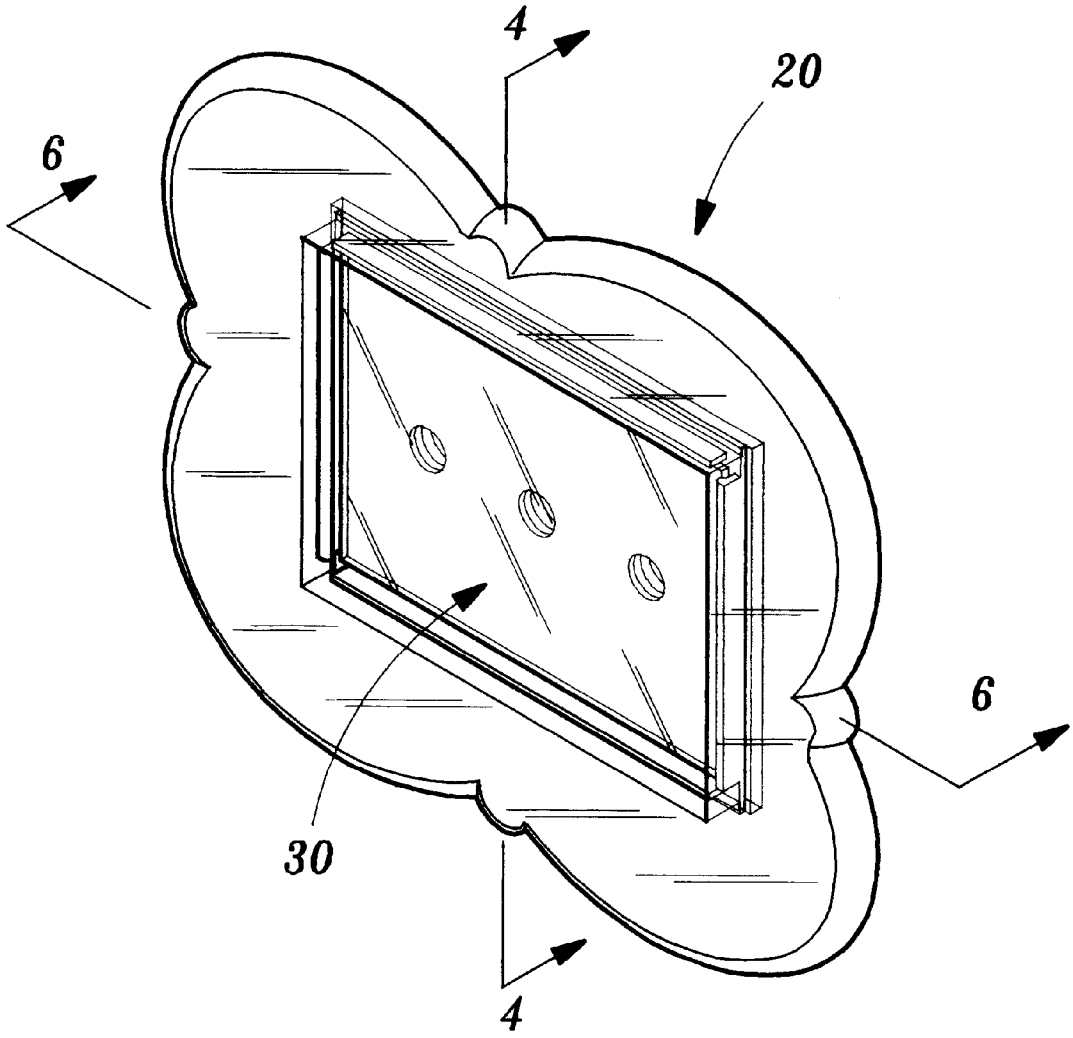
FIG. 2 is a perspective view showing a photograph frame of the present invention.
Figure 3:
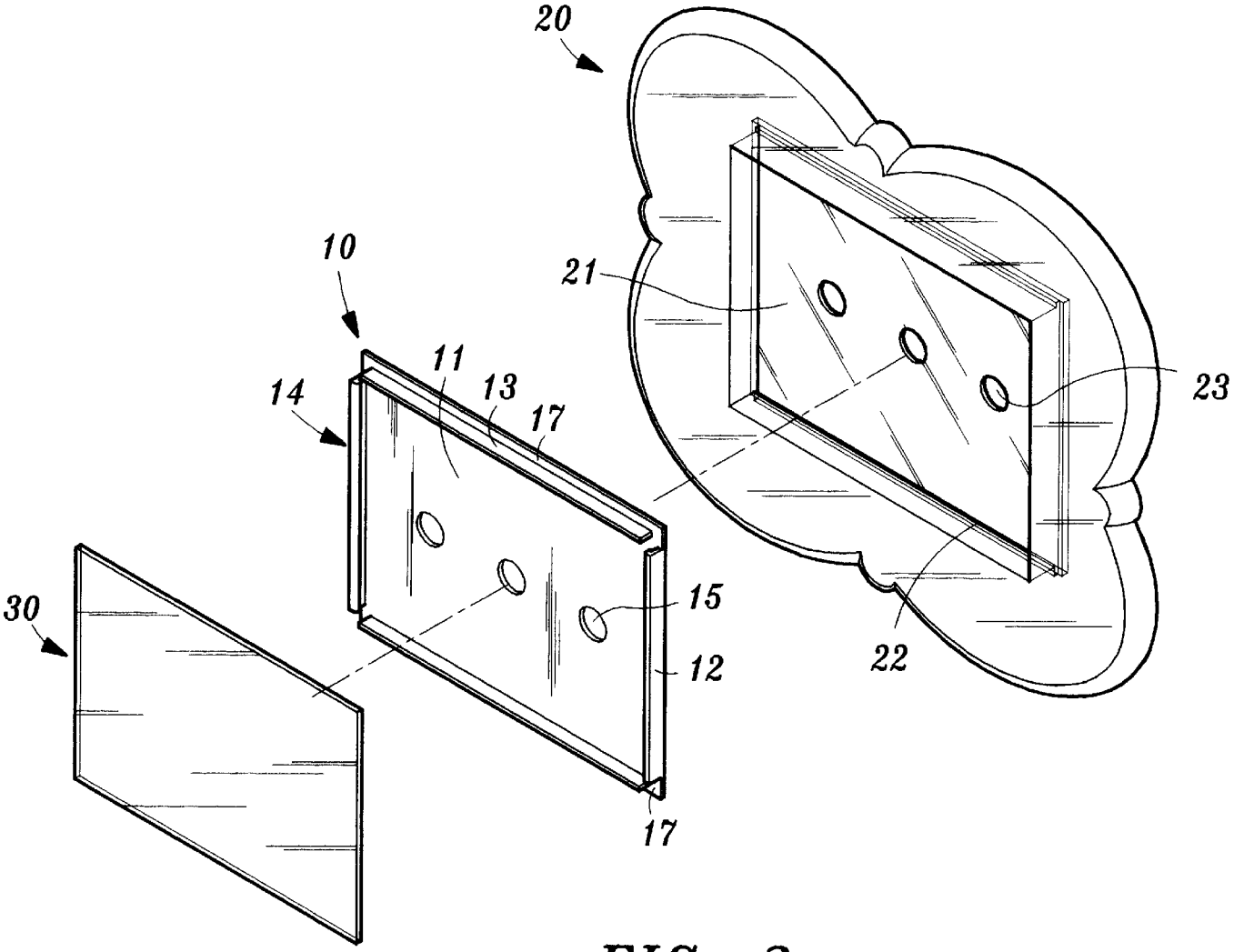
FIG. 3 is an exploded view showing the photograph frame of this invention.
Figure 4:
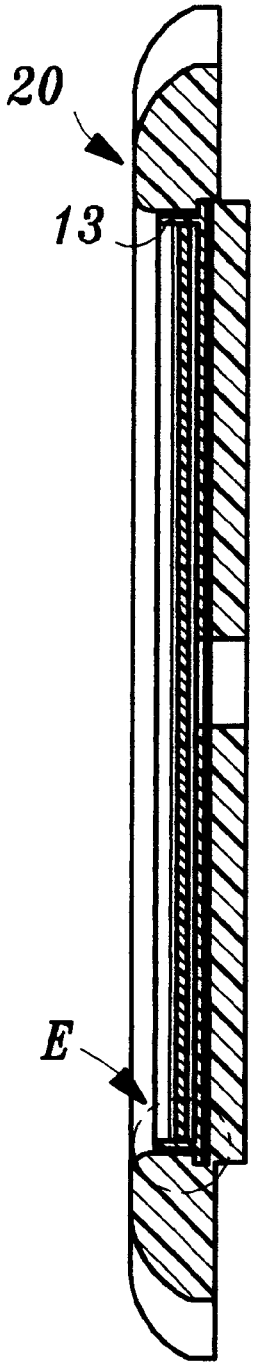
FIG. 4 is a sectional view on line 4—4 in FIG. 2.
Figure 5:
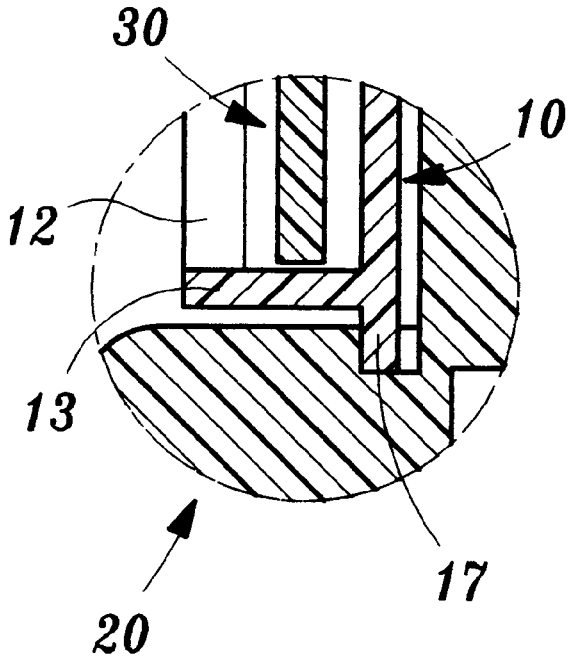
FIG. 5 is an enlarged view showing the area labelled "E" in FIG. 4.
Figure 6:
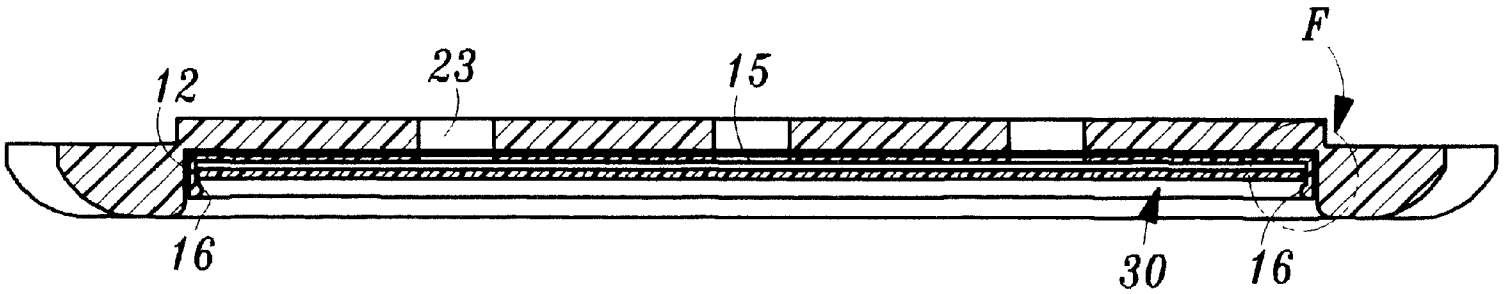
FIG. 6 is a sectional view on line 6—6 in FIG. 2.
Figure 7:
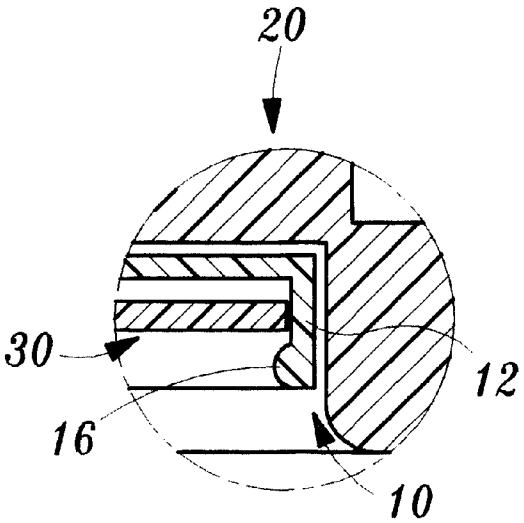
FIG. 7 is an enlarged view showing the area labelled "F" in FIG. 6.

Referring to FIG. 2, FIG. 3 and FIG. 4, the present invention is a photograph frame comprised of an intermediate plate 10, a back plate 20 and a face plate 30. The intermediate plate 10 has an inserting face 11. Two sides of the inserting face 11 have first fixing plates 12 extending perpendicularly from the inserting face 11. The upper side and the lower side of the inserting face 11 have second fixing plates 13 extending therefrom, such that the first fixing plates 12 and the second fixing plates 13 form a fixing frame 14 for receiving a photograph.

On the inserting face 11 there are a plurality of first hanging holes 15. The inner side of each first fixing plate 12 has a flange 16. At the top end and the bottom end of the inserting face 11 outside the two second fixing plates 13 are formed two inserting parts 17.

The back plate 20 can be designed in various patterns to increase its aesthetic value. On the back plate 20 ther is a recess 21. Inside the recess 21 are two inserting flutes 22. The inserting flutes 22 are ositioned such that the intermediate plate 10 can be fixed on the back plate 20 by pushing the inserting parts 17 into the inserting flutes 22 in the recess part 21. The recess part 21 also has a plurality of second hanging holes 23 which align with the first hanging holes 15.

The face plate 30 is made of transparent material, such as plastic or acrylic resin. The face plate 30 can be covered and fixed on the intermediate plate 10 by pushing two ends of the face plate 30 into the two flanges 16 formed in the first fixing plates 12.

Figure 8:
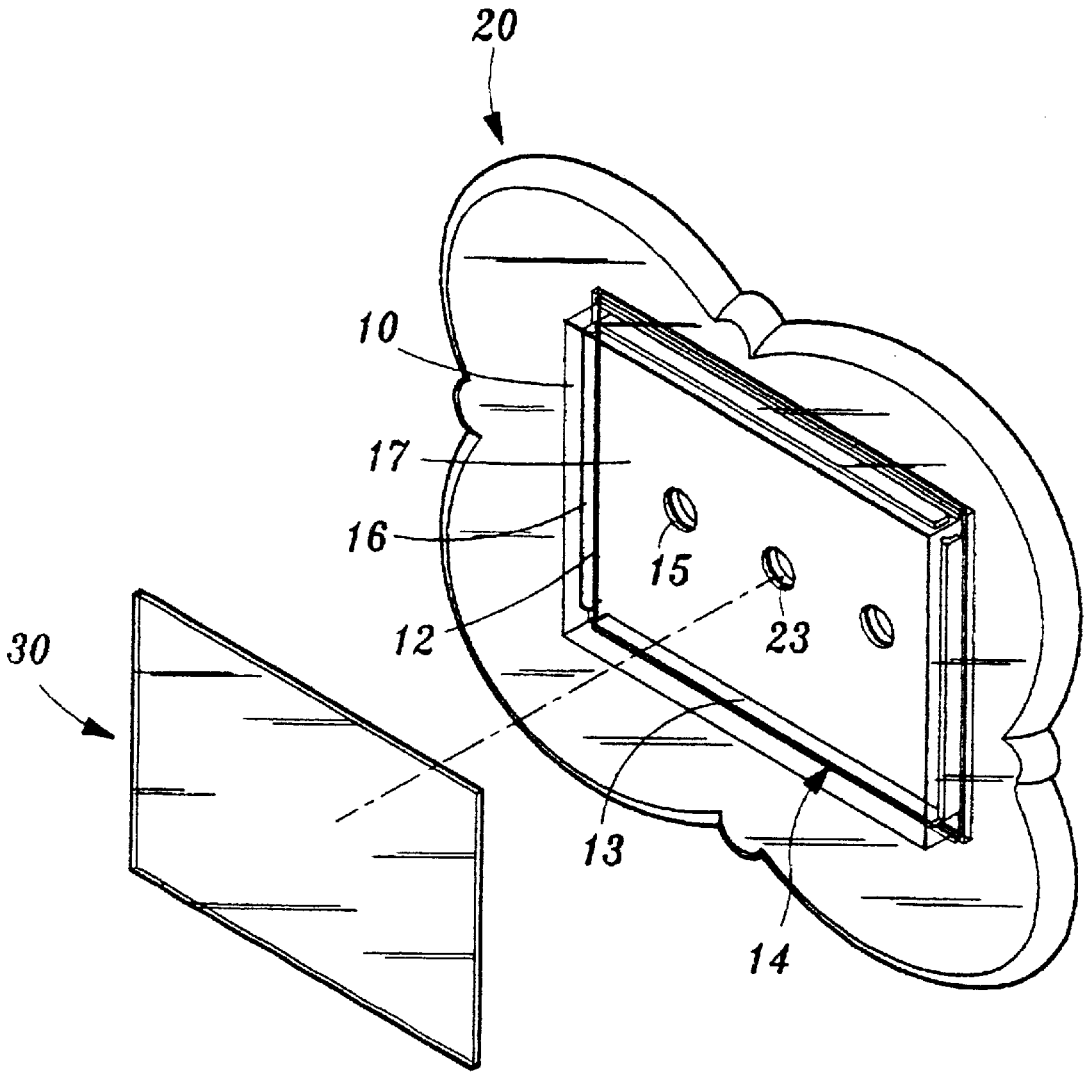
FIG. 8 is an exploded view showing a faceplate apart from an intermediate plate of this invention.

Please refer to FIG. 8, in which the photograph is put in the fixing frame 14 of the intermediate plate 10, then covered by the face plate 30 on the intermediate plate 10 so as to fix the photograph. The photograph frame can be hung on the wall by means of the first and second hanging holes 15, 23. If the user would like to take out the photograph, he can use his finger to push on the photograph and the face plate 30 through the second hanging holes of the back plate 20.

The photograph frame is made of plastic or acrylic resin to reduce its manufacturing cost. This kind of photograph frame is very light and is not easily broken. Accordingly, it is very convenient for a user to carry this photograph frame in various suitcases or handbags.

It is understood by those skilled in the art that the foregoing description is a preferred embodiment of the disclosed device, and that various changes and modifications may be made in the invention without departing from the spirit and scope thereof.

I claim:

1. A photograph frame comprising:

an intermediate plate having an inserting face, each of two sides of said inserting face has a first fixing plate extending upward therefrom, an upper side and a lower side of said inserting face each has a second fixing plate extending upward therefrom, such that said first fixing plates and second fixing plates form a fixing frame, an inner side of each of said first fixing plates has a flange formed thereon, a surface of said intermediate plate includes at least one first hanging hole therein;

a back plate with a recess formed therein, a surface of said back plate includes at least one second hanging hole therein, said second hanging hole is aligned with said first hanging hole; and a face plate made of transparent material, said face plate is fixed in said intermediate plate by pushing two ends of said face plate into said two flanges in said inner side of said intermediate plate, said face plate covers said inserting face of said intermediate plate; such that a user can secure a flat object such as a photograph beneath said face plate, said face plate adapted to cover said flat object, and the user can remove the flat object from said photograph frame by applying pressure to the face plate through said first and said second hanging holes to remove said face plate;

said first and said second hanging holes also being adapted to receive a hanging means to secure said photograph frame to a wall, and wherein said intermediate plate is completely received within said recess formed in said back plate.

2. The photograph frame as claimed in claim 1, wherein:

said intermediate plate and said back plate are connected to each other by means of an adhesive.

3. The photograph frame as claimed in claim 1, wherein:

said intermediate plate and said back plate are connected to each other by high frequency induction heating.

4. The photograph frame as claimed in claim 1, wherein:

said recess of said back plate includes on each of at least two sides thereof an inserting flute, said inserting flutes receive sides of said intermediate plate to secure said intermediate plate therein.

* * * * *